US009217290B2

(12) United States Patent
Martin

(10) Patent No.: US 9,217,290 B2
(45) Date of Patent: Dec. 22, 2015

(54) HIGH DEFINITION DRILLING RATE OF PENETRATION FOR MARINE DRILLING

(71) Applicant: Trenton Martin, Kingwood, TX (US)

(72) Inventor: Trenton Martin, Kingwood, TX (US)

(73) Assignee: TRANSOCEAN SEDCO FOREX VENTURES LIMITED, Grand Cayman (KY)

( * ) Notice: Subject to any disclaimer, the term of this patent is extended or adjusted under 35 U.S.C. 154(b) by 467 days.

(21) Appl. No.: 13/741,990

(22) Filed: Jan. 15, 2013

(65) Prior Publication Data

US 2013/0186685 A1 Jul. 25, 2013

Related U.S. Application Data

(60) Provisional application No. 61/589,445, filed on Jan. 23, 2012.

(51) Int. Cl.

| | |
|---|---|
| ***E21B 7/12*** | (2006.01) |
| ***E21B 45/00*** | (2006.01) |
| ***E21B 47/00*** | (2012.01) |
| ***E21B 47/04*** | (2012.01) |

(52) U.S. Cl.

CPC . *E21B 7/12* (2013.01); *E21B 45/00* (2013.01); *E21B 47/0001* (2013.01); *E21B 47/04* (2013.01)

(58) Field of Classification Search

CPC ..... E21B 7/12; E21B 45/00; E21B 47/0001
USPC ..... 175/5, 40; 166/358, 250.01; 702/9
See application file for complete search history.

(56) References Cited

U.S. PATENT DOCUMENTS

| | | | | | |
|---|---|---|---|---|---|
| 3,374,341 | A | * | 3/1968 | Klotz | 700/301 |
| 3,891,038 | A | * | 6/1975 | Delestrade et al. | 175/7 |
| 4,205,379 | A | * | 5/1980 | Fox et al. | 701/116 |
| 4,317,174 | A | * | 2/1982 | Dean | 701/116 |
| 4,616,321 | A | * | 10/1986 | Chan | 702/9 |
| 4,738,138 | A | | 4/1988 | Redman-White | |
| 4,852,052 | A | * | 7/1989 | Frey et al. | 702/9 |
| 5,209,302 | A | * | 5/1993 | Robichaux et al. | 166/355 |
| 5,398,546 | A | * | 3/1995 | Jeffryes | 73/152.44 |
| 5,978,739 | A | * | 11/1999 | Stockton | 702/6 |

(Continued)

FOREIGN PATENT DOCUMENTS

| | | |
|---|---|---|
| JP | S60-37394 A | 2/1985 |
| JP | H04-272312 A | 9/1992 |

OTHER PUBLICATIONS

International Search Report and Written Opinion mailed Sep. 13, 2013, issued during prosecution of International Application No. PCT/US2013/041072.

(Continued)

*Primary Examiner* — Matthew R Buck
(74) *Attorney, Agent, or Firm* — Norton Rose Fulbright US LLP

(57) ABSTRACT

Two sensors may be installed on a marine drill to improve measurements used for monitoring and operating the marine drill. The sensors may be installed in a differential configuration with one sensor located on a top block of the marine drill and a second sensor located on a drilling floor of the marine drill. Various calculations may be performed using measurements obtained from the two sensors such as, for example, rate of penetration of the marine drill, drilling level bubble for the marine drill, out of-straightness values for the marine drill, and vibration motion for the marine drill.

18 Claims, 6 Drawing Sheets

(56) References Cited

U.S. PATENT DOCUMENTS

| | | | | |
|---|---|---|---|---|
| 6,273,193 | B1 | 8/2001 | Hermann et al. | |
| 7,182,133 | B2 * | 2/2007 | Webre et al. | 166/250.01 |
| 2004/0211595 | A1 | 10/2004 | Pinckard et al. | |
| 2004/0226748 | A1 * | 11/2004 | Prior et al. | 175/27 |
| 2005/0251294 | A1 | 11/2005 | Cerwin | |
| 2006/0272861 | A1 | 12/2006 | Hutchinson | |
| 2007/0044536 | A1 | 3/2007 | Gunsaulis et al. | |
| 2008/0135290 | A1 * | 6/2008 | Hopwood et al. | 175/24 |
| 2008/0156531 | A1 * | 7/2008 | Boone et al. | 175/27 |
| 2009/0090555 | A1 * | 4/2009 | Boone et al. | 175/45 |
| 2010/0108384 | A1 | 5/2010 | Byreddy et al. | |
| 2010/0252325 | A1 * | 10/2010 | Porche | 175/40 |
| 2011/0174538 | A1 * | 7/2011 | Chan | 175/24 |
| 2011/0300008 | A1 | 12/2011 | Fielder et al. | |

OTHER PUBLICATIONS

International Search Report and Writtten Opinion mailed Mar. 22, 2013, issued during prosecution of International Application No. PCT/US2013/021958.

* cited by examiner

HIGH DEFINITION DRILLING RATE OF PENETRATION FOR MARINE DRILLING

CROSS REFERENCE TO RELATED APPLICATIONS

This application claims the benefit of priority of U.S. Provisional Patent Application No. 61/589,445 filed on Jan. 23, 2012, which is hereby incorporated by reference in its entirety.

TECHNICAL FIELD

The instant disclosure relates to marine drilling. More specifically, this disclosure relates to monitoring equipment for marine drilling.

BACKGROUND

In the marine drilling arena, vessel dynamics have a significant impact on both control and monitoring of the crown block. Although it is not strictly the crown block position with respect to the drill floor that is of consequence, the crown block position is an important consideration. In marine drilling with mobile offshore drilling units (MODU) the top drive may be the primary point of attachment of the drill string to the rig.

Conventionally, in both marine and land drilling, the instrument for measuring block position is a rotary encoder. Various types and attachment configurations of this encoder exist. There are at least two parties on the MODU with an interest in block position, each for slightly different reasons. The drill floor is a primary consumer of the block position information, due to the highly automated nature of drilling systems. The automation system monitors the block position for various control loops and safety interlocks. The other consumer of the block position data is third party service companies on board the MODU, such as mud loggers, measurement while drilling service providers, logging while drilling service providers, and directional drillers.

The encoder's placement on the drill floor has advantages and tradeoffs. The most convenient and reliable location for the encoder is mounted on the shaft of the draw works. The main advantage when mounted on the shaft is that the location allows for easy installation and maintenance. The drawback of this location is that systematic errors may be produced, because the encoder's observation is an indirect measurement. This placement for the encoder measures the drums' current rotation angle. Calibration is necessary to derive the block position. Calibration may be performed by using a direct distance measuring device such as a tape measure or electronic distance measurement (EDM) to generate a look-up table of block position to rotation increment. Placing the encoder on the rotary shaft of the draw works introduces a non-linear systematic error. In addition, the steel wire rope may deform, depending on temperature and load. Yet another possibility is to use a string encoder in place of a rotary encoder.

Conventionally, motion reference units (MRUs) and vertical reference units (VRUs) are used to provide measurements for active compensation for vessel heave. These units may be installed on the drill floor. The outputs from these sensors drive control loop feedback mechanisms such as proportional-integral-derivative (PID) controller loops in the control system in an attempt to maintain a constant weight on the bit.

SUMMARY

According to one embodiment, a method includes receiving first information from a first sensor located on a drill floor of a marine drill. The method also includes receiving second information from a second sensor located on a top drive of the marine drill. The method further includes calculating a physical parameter based, in part, on the first information received from the first sensor and the second information received from the second sensor.

According to another embodiment, a computer program product includes a non-transitory computer readable medium having code to receive first information from a first sensor located on a drill floor of a marine drill. The medium also includes code to receive second information from a second sensor located on a top drive of the marine drill. The medium further includes code to calculate a physical parameter based, in part, on the first information received from the first sensor and the second information received from the second sensor.

According to yet another embodiment, an apparatus includes a first sensor located on a drill floor of a marine drill. The apparatus also includes a second sensor located on a top drive of the marine drill. The first sensor and the second sensor are set-up in a differential configuration. The apparatus further includes a processor coupled to the first and second sensors. There is at least one processor configured to calculate a physical parameter based, in part, on the first information received from the first sensor and the second information received from the second sensor.

The foregoing has outlined rather broadly the features and technical advantages of the present disclosure in order that the detailed description of the disclosure that follows may be better understood. Additional features and advantages of the disclosure will be described hereinafter which form the subject of the claims of the disclosure. It should be appreciated by those skilled in the art that the conception and specific embodiment disclosed may be readily utilized as a basis for modifying or designing other structures for carrying out the same purposes of the present disclosure. It should also be realized by those skilled in the art that such equivalent constructions do not depart from the spirit and scope of the disclosure as set forth in the appended claims. The novel features which are believed to be characteristic of the disclosure, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present disclosure.

BRIEF DESCRIPTION OF THE DRAWINGS

For a more complete understanding of the disclosed system and methods, reference is now made to the following descriptions taken in conjunction with the accompanying drawings.

DETAILED DESCRIPTION

Figure 1:
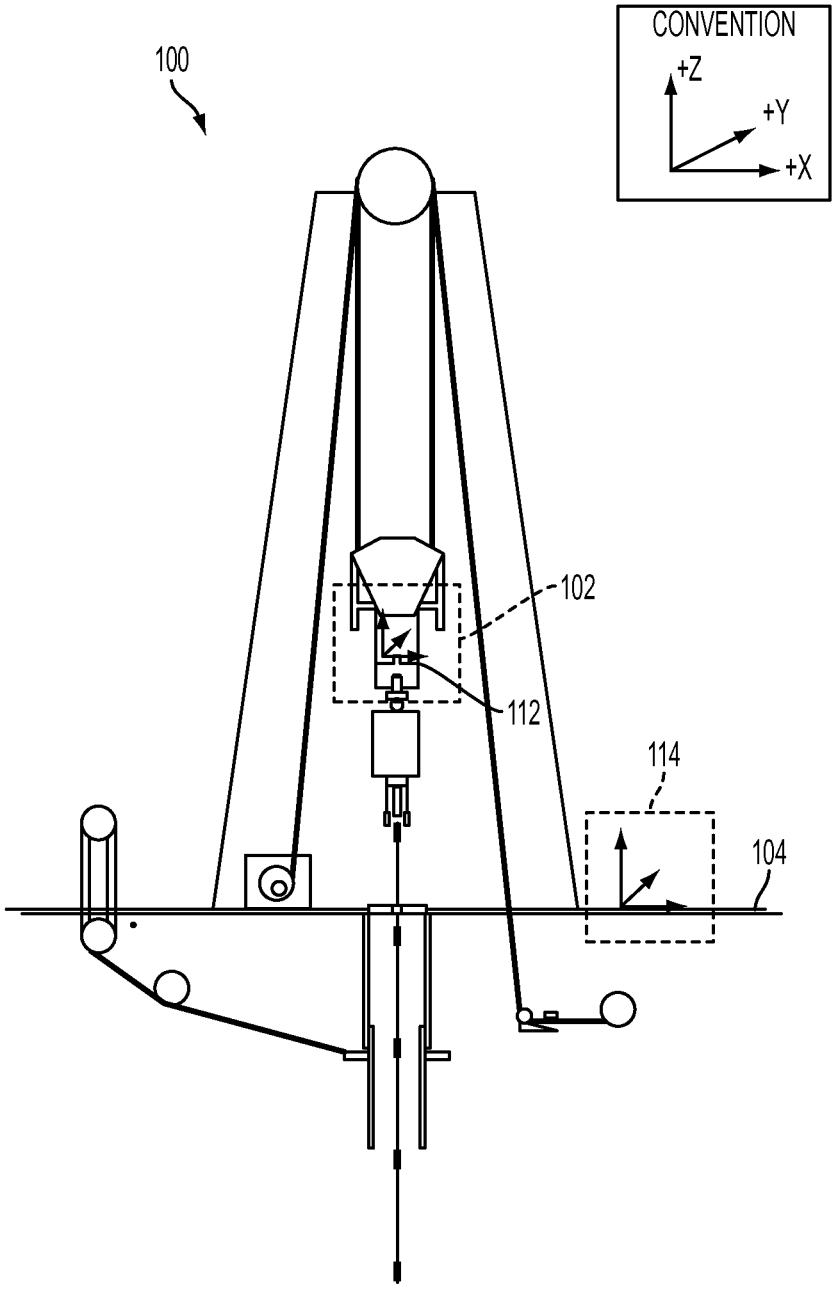
FIG. 1 is a block diagram illustrating a marine drill with two sensors according to one embodiment of the disclosure.

A second sensor may be installed on a marine drill, such as on a top block, to improve measurements used for monitoring and operating the marine drill. FIG. 1 is a block diagram illustrating a marine drill with two sensors according to one embodiment of the disclosure. A marine drill 100, such as a mobile offshore drilling unit (MODU), may include a drill floor 104. A first sensor 114 may be located on the drill floor 104. The first sensor 114 may include one or more of an accelerometer, a gyroscope, and a compass. According to one embodiment, the first sensor 114 may be appropriately rated for explosively hazardous areas. The marine drill 100 may also include a top block 102.

A second sensor 112 may be located on the top block 102. The second sensor 112 may include one or more of an accelerometer, as gyroscope, and a compass. According to one embodiment, the second sensor 112 is mounted on the top block 102. The first sensor 114 and the second sensor 112 may be set-up in a differential configuration. For example, measurements may be taken from the first sensor 114 and the second sensor 112 nearly simultaneously, such that movement of the drill floor 104 detected by the first sensor 114 may be subtracted from the movement of the top block 102 detected by the second sensor 112. The first sensor 114 and the second sensor 112 may be coupled to a processor (not yet shown) for calculating physical parameters of the marine drill 100.

Figure 2:
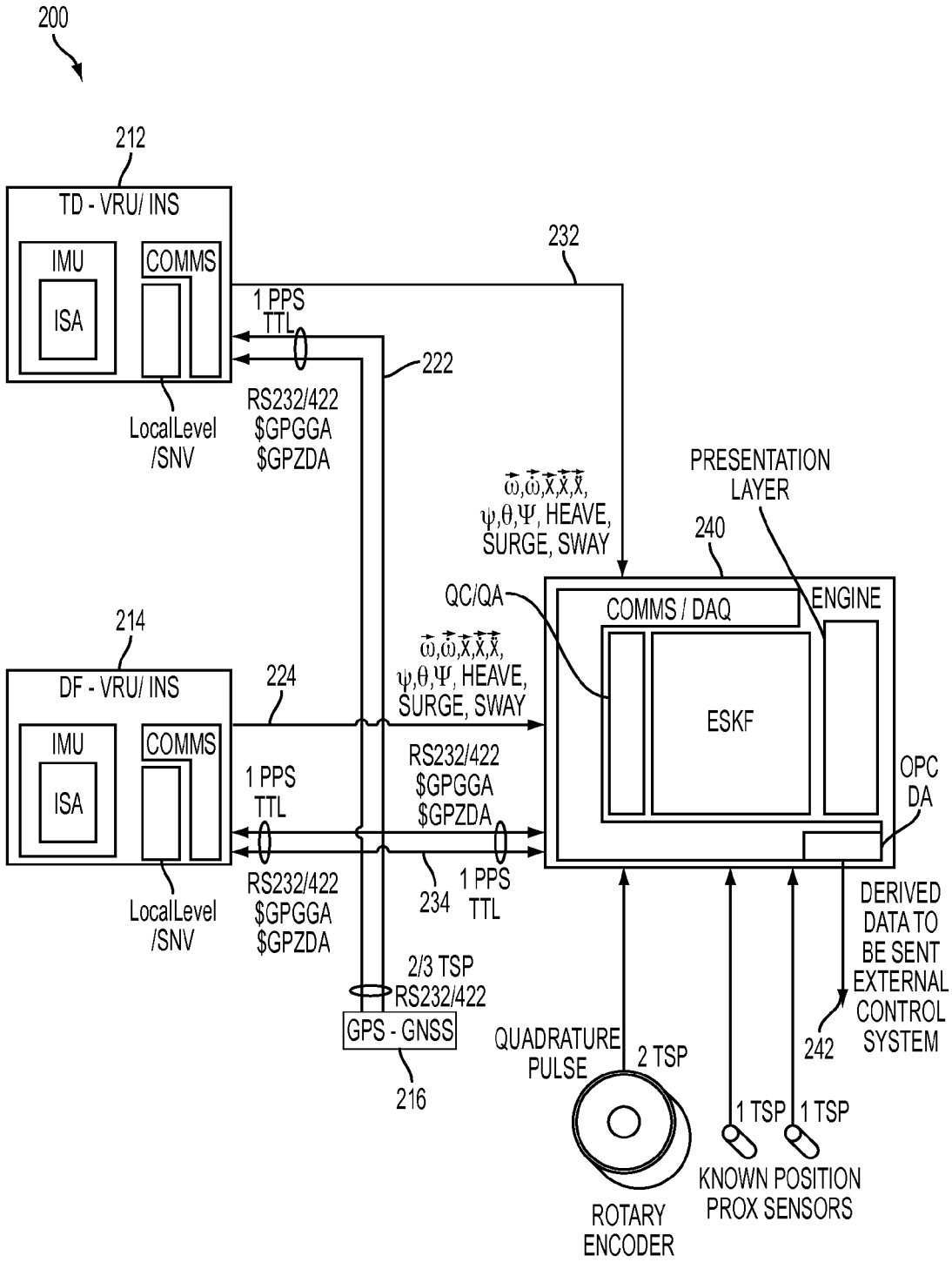
FIG. 2 is a block diagram illustrating a communications system for coupling two sensors on a marine drill according to one embodiment of the disclosure.

FIG. 2 is a block diagram illustrating a communications system for coupling two sensors on a marine drill according to one embodiment of the disclosure. A processor 240 may receive information from a first sensor 214, such as a sensor located on a drill floor, through a communications bus 224. The processor 240 may further communicate with the first sensor 214 through a command bus 234, such as a RS-232 or RS-422 serial bus. The processor 240 may also receive information from a second sensor 212, such as a sensor located on a top block, through a communications bus 232. A positioning data system 216, such as global positioning system (GPS) or global navigation satellite system (GNSS), may be coupled to the second sensor 212 to provide position information through a communications bus 222, such as a RS-232 or RS-422 serial bus. The processor 240 may receive information from the first sensor 214 and the second sensor 212 such as, for example, heave, surge, and/or sway values. The processor 240 may then calculate physical parameters based on, in part, the information received from the first sensor 214 and the second sensor 212. The processor 240 may provide the calculated physical parameters to an external device (not shown) through a communications bus 242. According to one embodiment, a time synchronization message and pulse may be provided to the first sensor 214 and the second sensor 212 to coordinate measurement by the two sensors 212 and 214.

Figure 3:
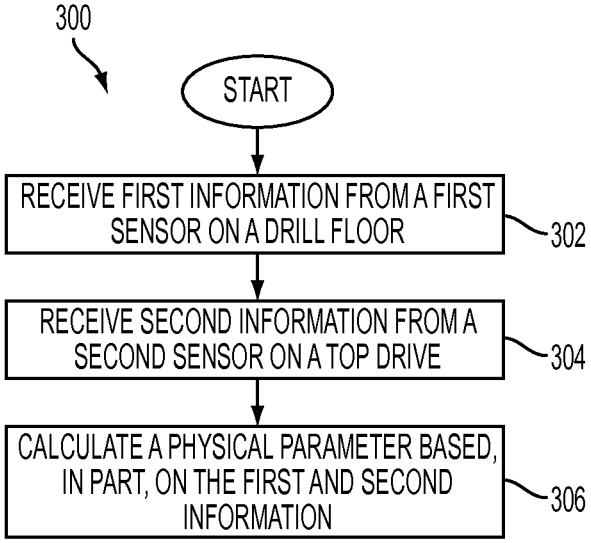
FIG. 3 is a flow chart illustrating a method for operating two sensors on a marine drill according to one embodiment of the disclosure.
Figure 4:
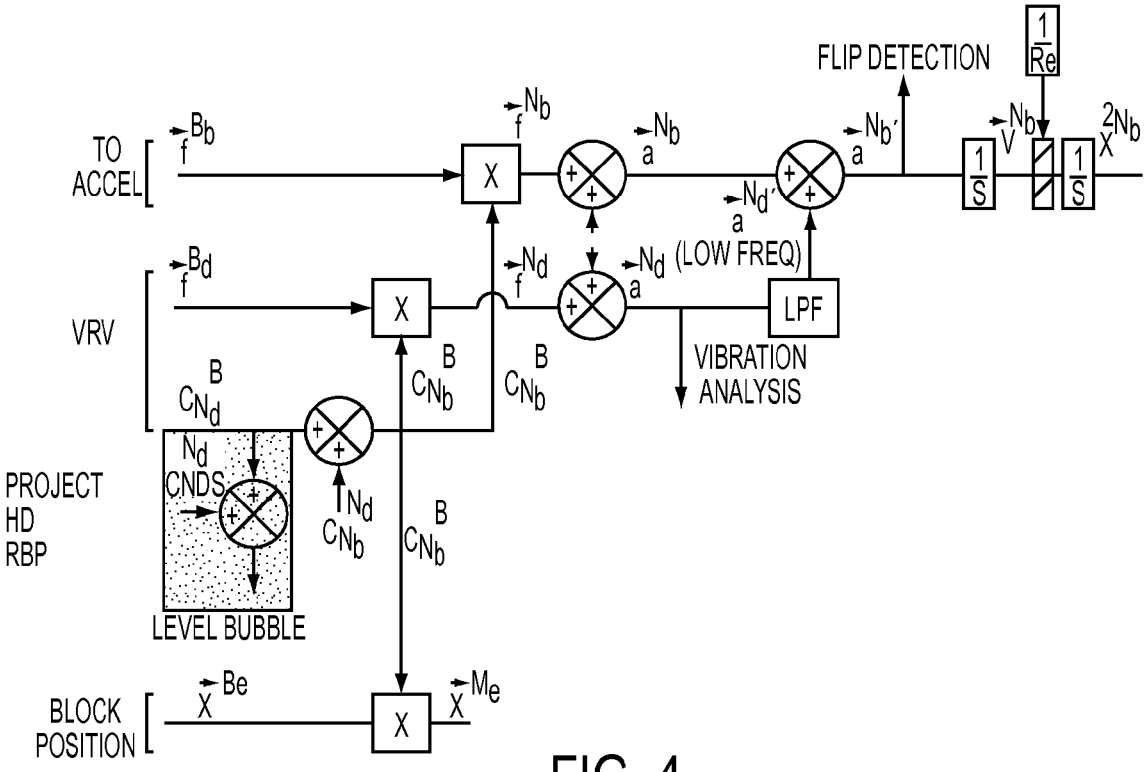
FIG. 4 is a block diagram illustrating mechanization of receiving information from two sensors on a marine drill according to one embodiment of the disclosure.
Figure 5:
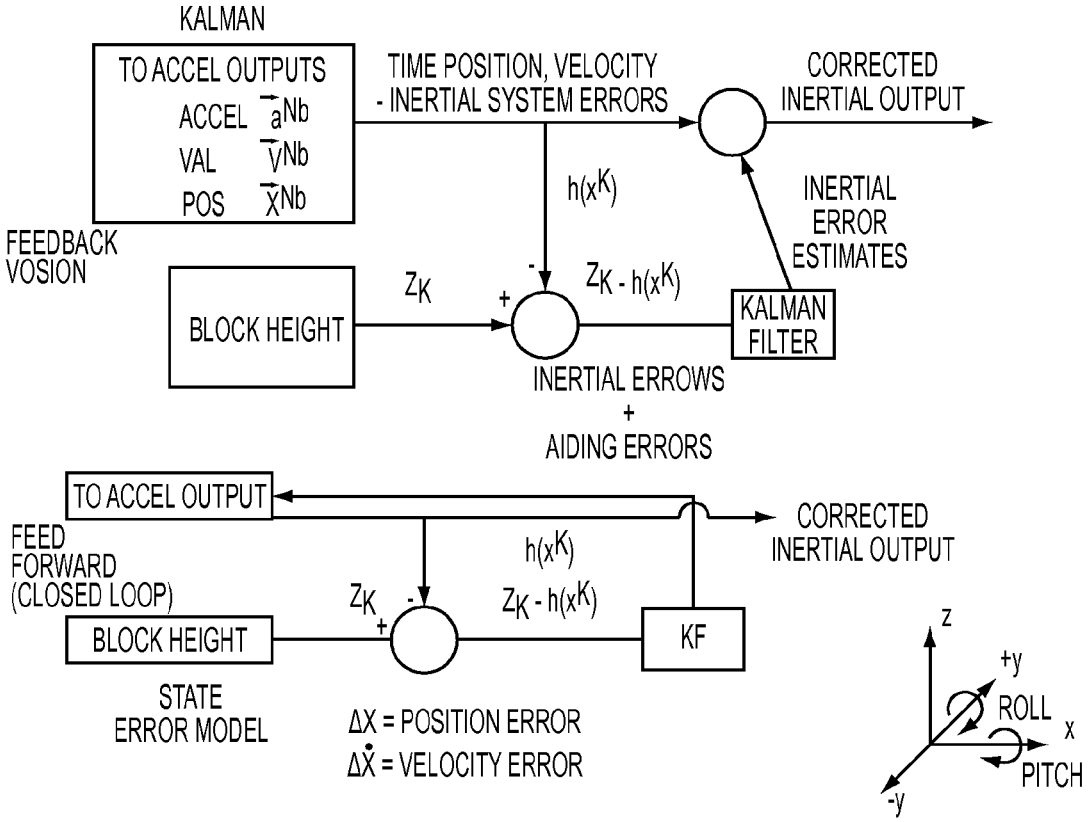
FIG. 5 is a block diagram illustrating an atypical error state Kalman filter loop according to one embodiment of the disclosure.

FIG. 3 is a flow chart illustrating a method for operating two sensors on a marine drill according to one embodiment of the disclosure. A method 300 begins at block 302 with receiving first information from a first sensor on a drill floor of a marine drill. The method 300 continues to block 304 to receive second information from a second sensor on a top drive of a marine drill. The method 300 the continues to block 306 to calculate a physical parameter based, in part, on the first and second information received at blocks 302 and 304, respectively. Additional details of the calculation process are presented in FIGS. 4 and 5. FIG. 4 is a block diagram illustrating mechanization of receiving information from two sensors on a marine drill according to one embodiment of the disclosure. FIG. 5 is a block diagram illustrating an atypical error state Kalman filter loop according to one embodiment of the disclosure.

According to one embodiment, the calculation at block 306 may include calculating a high definition rate of penetration (HDROP). HDROP refers to an accurate and precise pose estimation of the top drive and/or top block. The calculation of HDROP may use a proportional-integral-derivative (PID) loop and/or an optimal estimator such as an Error State Kalman Filter (ESKF). The results of the PID loop may be compared to the ESKF for a simple single state solution of noisy heave. During the design and development of the algorithm, dynamic simulations may be used to emulate the observables based on known models. In another solution, calculations may start with true dynamics and then model the sensor outputs and additional errors to form new discretized data sets fed to the optimal estimator. The current block position calculation may be based on configurations having a draw works rotary encoder on a jackup, having a draw works rotary encoder on a floating drilling platform (floater) with passive compensation and riser tensioners, having a draw works rotary encoder on a floater with active heave compensation.

According to another embodiment, the calculation at block 306 may include calculating a digital visualization of drilling level bubble. The drilling level bubble may be displayed on a screen to provide a driller and/or a rig captain a visual indication of an ideal orientation for leveling, to reduce the likelihood binding of the tubular in the rotary table. According to one embodiment, systemic errors, such as angular offsets, may be removed during the calculation. The calculation for a drilling level bubble may leverage inertial measurement unit (IMU) data, but may be performed without an error state Kalman filter and/or accurate time tagging.

According to yet another embodiment, the calculation at block 306 may include calculating an out-of-straightness (OOS) value. The information from the two sensors for a single sensor for a jackup) may be monitored to determine any mechanical binding of the top drive on the rails due to deformation as the top drive transitions from the rotary table to the crown. A difference in orientation along the length of the rails may be calculated based on information from the two sensors. This difference may serve as a baseline measurement to compare with future measurements to determine if deformation of the rails has occurred. An accurate instantaneous position of the top block may be calculated for OOS monitoring from an ESKF.

According to a further embodiment, the calculation at block 306 may include condition based monitoring. Sensors, such as accelerometers, placed on machinery on a marine drill may measure vibrations for that machinery. Sensors on the top drive may measure a wide spectrum of components in the frequency domain, including low frequency vibrations due to vessel motion and high frequency vibrations due to motor operations. By nearly simultaneously measuring vibrations at another location, such as the drill floor, the sensor inputs may be differentially combined to calculate the actual motion of the top drive. By accomplishing this, vessel motion and drill floor vibrations may be removed or reduced from the top drives vibrations.

Other applications for differential sensor configurations on a marine drill include seismic while drilling (SWD) and drill-break detection by determining bit movement and/or vibration returns, and fine motion control on the marine drill. The use of differential inertial sensors as described above improve the accuracy of measurements from a marine drill and improve the operation of the marine drill. For example, when differential sensors are placed on the top block and the drilling floor, measurements may be taken from the sensors and used to calculate a variety of physical parameters used in monitoring or operating the marine drill.

One application for a differential sensor configuration on a marine drill include precision motion control. Once an accurate spatial location of the block and the block's dynamics are known fine motion control applications may be implemented. This provides more accurate dynamic information than what is inferred by the rotary encoder.

Figure 6:
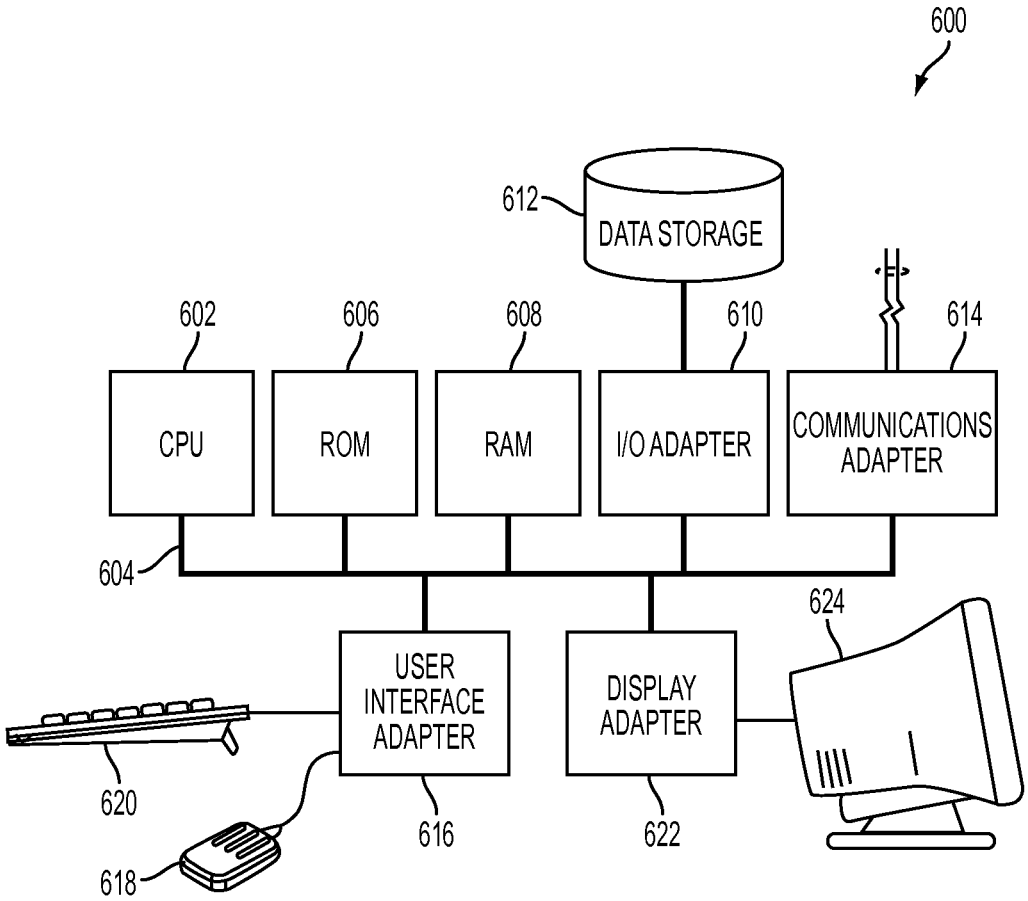
FIG. 6 is a block diagram illustrating a computer system according to one embodiment of the disclosure.

FIG. 6 illustrates a computer system 600 adapted according to certain embodiments as a server and/or a user interface device for processing and/or displaying data from the differential sensors of FIG. 1 and FIG. 2. The central processing unit ("CPU") 602 is coupled to the system bus 604. The CPU 602 may be a general purpose CPU or microprocessor, graphics processing unit ("GPU"), and/or microcontroller. The present embodiments are not restricted by the architecture of the CPU 602 so long as the CPU 602, whether directly or indirectly, supports the modules and operations as described herein. The CPU 602 may execute the various logical instructions according to the present embodiments, such as the method illustrated in FIG. 3.

The computer system 600 also may include random access memory (RAM) 608, which may be synchronous RAM (SRAM), dynamic RAM (DRAM), and/or synchronous dynamic RAM (SDRAM). The computer system 600 may utilize RAM 608 to store the various data structures used by a software application, such as information received from the first and second sensors. The computer system 600 may also include read only memory (ROM) 606 which may be PROM, EPROM, EEPROM, optical storage, or the like. The ROM may store configuration information for booting the computer system 600. The RAM 60 and the ROM 606 hold user and system data.

The computer system 600 may also include an input/output (I/O) adapter 610, a communications adapter 614, a user interface adapter 616, and a display adapter 622. The I/O adapter 610 and/or the user interface adapter 616 may, in certain embodiments, enable a user to interact with the computer system 600. In a further embodiment, the display adapter 622 may display a graphical user interface (GUI) associated with a software or web-based application on a display device 624, such as a monitor or touch screen.

The I/O adapter 610 may couple one or more storage devices 612, such as one or more of a hard drive, a flash drive, a compact disc (CD) drive, a floppy disk drive, and a tape drive, to the computer system 600. The communications adapter 614 may be adapted to couple the computer system 600 to a network, which may be one or more of a LAN, WAN, and/or the Internet. The communications adapter 614 may also be adapted to couple the computer system 600 to other networks such as a global positioning system (GPS) or a Bluetooth network. The user interface adapter 616 couples user input devices, such as a keyboard 620, a pointing device 618, and/or a touch screen (not shown) to the computer system 600. The keyboard 620 may be an on-screen keyboard displayed on a touch panel. Additional devices (not shown) such as a camera, microphone, video camera, accelerometer, compass, and or a gyroscope may be coupled to the user interface adapter 616. The display adapter 622 may be driven by the CPU 602 to control the display on the display device 624.

The applications of the present disclosure are not limited to the architecture of computer system 600. Rather the computer system 600 is provided as an example of one type of computing device that may be adapted to perform the functions of as server and/or a user interface device. For example, any suitable processor-based device may be utilized including, without limitation, personal data assistants (PDAs), tablet computers, smartphones, computer game consoles, and multiprocessor servers. Moreover, the systems and methods of the present disclosure may be implemented on application specific integrated circuits (ASIC), very large scale integrated (VLSI) circuits, or other circuitry. In fact, persons of ordinary skill in the art may utilize any number of suitable structures capable of executing logical operations according to the described embodiments.

If implemented in firmware and/or software, the functions described above may be stored as one or more instructions or code on a computer-readable medium. Examples include non-transitory computer-readable media encoded with a data structure and computer-readable media encoded with a computer program. Computer-readable media includes physical computer storage media. A storage medium may be any available medium that can be accessed by a computer. By way of example, and not limitation, such computer-readable media can comprise RAM, ROM, EEPROM, CD-ROM or other optical disk storage, magnetic disk storage or other magnetic storage devices, or any other medium that can be used to store desired program code in the form of instructions or data structures and that can be accessed by a computer; disk and disc, as used herein, includes compact disc (CD), laser disc, optical disc, digital versatile disc (DVD), floppy disk and blu-ray disc where disks usually reproduce data magnetically, while discs reproduce data optically with lasers. Combinations of the above should also be included within the scope of computer-readable media.

In addition to storage on computer readable medium, instructions and/or data may be provided as signals on transmission media included in a communication apparatus. For example, a communication apparatus may include a transceiver having signals indicative of instructions and data. The instructions and data are configured to cause one or more processors to implement the functions outlined in the claims.

Although the present disclosure and its advantages have been described in detail, it should be understood that various changes, substitutions and alterations can be made herein without departing from the spirit and scope of the disclosure as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the present disclosure, machines, manufacture, compositions of matter, means, methods, or steps, presently existing or later to be developed that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps.

What is claimed is:

1. A method, comprising:

receiving first information from a first sensor located on a drill floor of a marine drill;

receiving second information from a second sensor located on a top drive of the marine drill;

generating a time synchronization pulse to co-ordinate receiving the first information from the first sensor and receiving the second information from the second sensor; and calculating a physical parameter based, in part, on the co-ordinated first information received from the first sensor and the second information received from the second sensor.

2. The method of claim 1, in which the marine drill is a mobile offshore drilling unit.

3. The method of claim 1, in which the step of calculating comprises calculating a rate of penetration for the marine drill.

4. The method of claim 1, in which the step of calculating comprises calculating a drilling level bubble for the marine drill.

5. The method of claim 1, in which the step of calculating comprises calculating an out-of-straightness value for the marine drill.

6. The method of claim 1, in which the step of calculating comprises calculating vibration motion for the marine drill.

7. The method of claim 1, in which the step of calculating comprises calculating a spatial location and dynamics of a block of the marine drill.

8. A computer program product, comprising:

a non-transitory computer readable medium comprising:

code to receive first information from a first sensor located on a drill floor of a marine drill;

code to receive second information from a second sensor located on a top drive of the marine drill;

code to generate a time synchronization pulse to co-ordinate receiving the first information from the first sensor and receiving the second information from the second sensor; and code to calculate a physical parameter based, in part, on the first information received from the first sensor and the second information received from the second sensor.

9. The computer program product of claim 8, in which the medium further comprises code to calculate a rate of penetration for the marine drill.

10. The computer program product of claim 8, in which the medium further comprises code to calculate a drilling level bubble for the marine drill.

11. The computer program product of claim 8, in which the medium further comprises code to calculate an out-of-straightness value for the marine drill.

12. The computer program product of claim 8, in which the medium further comprises code to calculate vibration motion for the marine drill.

13. The computer program product of claim 8, in which the medium further comprises code to calculate a spatial location and dynamics of a block of the marine drill.

14. An apparatus, comprising:

a first sensor located on a drill floor of a marine drill;

a second sensor located on a top drive of the marine drill, in which the first sensor and the second sensor are set-up in a differential configuration; and a processor coupled to the first sensor and the second sensor, in which the processor is configured to:

generate a time synchronization pulse to co-ordinate receiving first information from the first sensor and receiving second information from the second sensor; and calculate a physical parameter based, in part, on the first information received from the first sensor and the second information received from the second sensor.

15. The apparatus of claim 14, in which the processor is further configured to calculate a rate of penetration for the marine drill.

16. The apparatus of claim 14, in which the processor is further configured to calculate a drilling level bubble for the marine drill.

17. The apparatus of claim 14, in which the processor is further configured to calculate an out-of-straightness value for the marine drill.

18. The apparatus of claim 14, in which the marine drill is a mobile offshore drilling unit.

* * * * *